US009121245B2

(12) United States Patent
DeOcampo et al.

(10) Patent No.: US 9,121,245 B2
(45) Date of Patent: Sep. 1, 2015

(54) SPHERICAL-ANNULAR BLOWOUT PREVENTER HAVING A PLURALITY OF PISTONS

(71) Applicant: ZP Interests, LLC, Houston, TX (US)

(72) Inventors: Hernani G. DeOcampo, Spring, TX (US); Dean Madell, Busby (CA); Dennis D. Lam, Houston, TX (US)

(73) Assignee: ZP Interests, LLC, Houston, TX (US)

( * ) Notice: Subject to any disclaimer, the term of this patent is extended or adjusted under 35 U.S.C. 154(b) by 146 days.

(21) Appl. No.: 14/087,091

(22) Filed: Nov. 22, 2013

(65) Prior Publication Data

US 2015/0144813 A1 May 28, 2015

(51) Int. Cl.
*E21B 33/06* (2006.01)

(52) U.S. Cl.
CPC ..... *E21B 33/06* (2013.01)

(58) Field of Classification Search
CPC ..... E21B 33/06
USPC ..... 251/1.1–1.3; 166/84.3
See application file for complete search history.

(56) References Cited

U.S. PATENT DOCUMENTS

| | | | | | |
|---|---|---|---|---|---|
| 2,609,836 | A | | 9/1952 | Knox | |
| 2,904,357 | A | | 9/1959 | Knox | |
| 3,533,468 | A | * | 10/1970 | Dunn et al. | 166/363 |
| 3,667,721 | A | | 6/1972 | Vujasinovic | |
| 4,098,341 | A | * | 7/1978 | Lewis | 166/387 |
| 4,153,278 | A | * | 5/1979 | Ahlstone | 285/18 |
| 4,378,849 | A | * | 4/1983 | Wilks | 166/369 |
| 5,662,171 | A | | 9/1997 | Brugman et al. | |
| 6,070,669 | A | * | 6/2000 | Radi et al. | 166/368 |
| 7,874,353 | B2 | * | 1/2011 | Williams et al. | 166/84.3 |
| 2008/0105340 | A1 | * | 5/2008 | Huff et al. | 148/607 |

* cited by examiner

*Primary Examiner* — Marina Tietjen
*Assistant Examiner* — Daphne M Barry
(74) *Attorney, Agent, or Firm* — David L. Odom

(57) ABSTRACT

A blowout preventer assembly is provided and is generally configured having an upper housing, a lower housing with a plurality of internally interconnected cylinders, a one piece energizing ring, and a plurality of individual bottom cover plates all enclosing a lower housing column bore for receiving well pipe. The blowout preventer assembly also has a plurality of annular pistons, a plurality of associated glands disposed in each cylinder with each piston, a main seal with a plurality of main seal ribs, an adaptor ring, and various dedicated and associated seals and threaded attachments.

6 Claims, 8 Drawing Sheets

SPHERICAL-ANNULAR BLOWOUT PREVENTER HAVING A PLURALITY OF PISTONS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

Embodiments disclosed herein generally relate to blowout preventers used in the oil and gas industry during oil and gas well drilling and work over to prevent escape of well bore pressure into the outside environment in the event of an unexpected pressure "kick" due to the influx of formation fluid or other uncontrolled situations. Specifically, embodiments discussed herein relate to an annular-spherical blowout preventer design having multiple pistons and glands.

Well control is an important aspect of oil and gas exploration. For example, when drilling a well, safety devices must be put in place to prevent damage to equipment and, most importantly, to personnel resulting from unexpected events associated with drilling operations. Because of safety conditions and risk of blowouts devices known as blowout preventers (BOPS) are installed above the wellhead at the surface or on the sea floor in deep water situations to effectively seal a wellbore until measures can be taken to control the kick. Blowout preventers are large, specialized high-pressure valves or similar mechanical devices, typically installed redundantly in stacks and used to seal and control downhole pressure and monitor oil and gas wells to ultimately prevent the uncontrolled flow of liquids and gases during well drilling operations. Blowout preventers come in a variety of styles, sizes and pressure ratings and often several individual units serving various functions are combined to compose a blowout preventer stack. Some of the functions of a blowout preventer system include, but are not limited to, confining well fluid to the wellbore, providing a means to add fluid to the wellbore, allowing controlled volumes of fluid to be withdrawn from the wellbore, regulating and monitoring wellbore pressure, and sealing the wellhead.

In addition to controlling the downhole pressure and the flow of oil and gas, blowout preventers are intended to prevent tubing, tools and drilling fluid from being blown out of the wellbore when a blowout threatens. Blowout preventers are critical to the safety of crew, rig and environment, and to the monitoring and maintenance of well integrity. Thus, blowout preventers are intended to be fail-safe devices. Multiple blowout preventers of the same type are frequently provided for redundancy, an important factor in the effectiveness of fail-safe devices.

There are two major types of blowout preventers, annular and RAM. Annular BOPs are usually mounted to the very top of a BOP stack. The drilling crew then typically mounts a predetermined number of RAM BOPs below the annular blowout preventer. Blowout preventers were developed to cope with extreme erratic pressures and uncontrolled flow, often referred to as formation kick, emanating from a well reservoir during drilling. Kicks can lead to a potentially catastrophic event known as a "blowout." If a kick is detected, the annular is usually closed first and then the RAM is used as a backup if the annular should fail. Often times during operation BOPs are damaged and repair is difficult if not impossible when dealing with internal component damage such as pistons.

In drilling a typical high-pressure well, drill strings are routed through a blowout preventer stack toward the reservoir of oil and gas. As the well is drilled, drilling fluid, "mud", is fed through the drill string down to the drill bit, "blade," and returns up the wellbore in the ring-shaped void, annulus, between the outside of the drill pipe and the casing (piping that lines the wellbore). The column of drilling mud exerts downward hydrostatic pressure to counter opposing pressure from the formation being drilled, allowing drilling to proceed. When a kick occurs, rig operators or automatic systems close the blowout preventer units, sealing the annulus to stop the flow of fluids out of the wellbore. Denser mud is then circulated into the wellbore down the drill string, up the annulus and out through the choke line at the base of the BOP stack through chokes until downhole pressure is overcome. If the blowout preventers and mud do not restrict the upward pressures of a kick a blowout results, potentially shooting tubing, oil and gas up the wellbore, damaging the rig, and leaving well integrity in question.

SUMMARY OF THE INVENTION

In accordance with the teachings provided herein for a blowout preventer, one embodiment provides a blowout preventer assembly comprising a containment structure, wherein the containment structure comprises a unitary lower housing with a plurality of lower housing bifurcated retainer lugs disposed circumferentially about an attachment end of the lower housing, wherein the lower housing further includes a plurality of internal fluidly interconnected cylinders; a plurality of annular pistons and glands engaging the plurality of fluidly interconnected cylinders in the lower housing; a one piece energizing ring having a bowl in one end portion, wherein the energizing ring is operationally disposed circumferentially about a portion of the lower housing and in engagement with the plurality of annular pistons; an upper housing having an integral structure with a plurality of upper housing bifurcated retainer lugs for interlace quarter turn engagement with the lower housing plurality of bifurcated retainer lugs, wherein the upper housing further includes an inner ceiling with a spherical, concave shaped main bore for accommodating a main seal positioned over the bowl portion, wherein the lower housing and upper housing operationally enclose the one piece energizing ring, annular pistons, glands and seal; and a plurality of bottom plates for sealing the lower housing from an outside environment.

In another embodiment, a blowout preventer is provided comprising a lower housing having a unitary generally cylindrical shaped structure with a plurality of bifurcated retainer lugs; a plurality of internal fluidly interconnected cylinders configured in a plane surface of the integral structure, wherein each internal fluidly interconnected cylinder includes a dedicated cylinder fluid channel disposed therein a portion of a cylinder wall; a center column defining a center bore for accommodating a well pipe, wherein the center column comprises a plurality of seals; and a flange mounting portion disposed at a distal end of the center column.

In yet another embodiment, a blowout preventer is provided comprising an energizing ring having a generally cylindrical, one-piece integral structure having a bowl shaped surface opening machined into a first end portion of the energizing ring; and a plurality of bifurcated heel shaped mounting elements machined into a second end portion of the energizing ring.

BRIEF DESCRIPTION OF THE SEVERAL VIEWS OF THE DRAWINGS

The foregoing summary, as well as the following detailed description, will be better understood when read in conjunction with the appended drawings. For the purpose of illustration, certain embodiments of the present disclosure are shown in the drawings. It should be understood, however, that the invention is not limited to the precise arrangements and instrumentalities shown. The accompanying drawings, which are incorporated in and constitute a part of this specification, illustrate an implementation of system, apparatuses, and methods consistent with the present invention and, together with the description, serve to explain advantages and principles consistent with the invention.

DETAILED DESCRIPTION OF THE INVENTION

Figure 1:
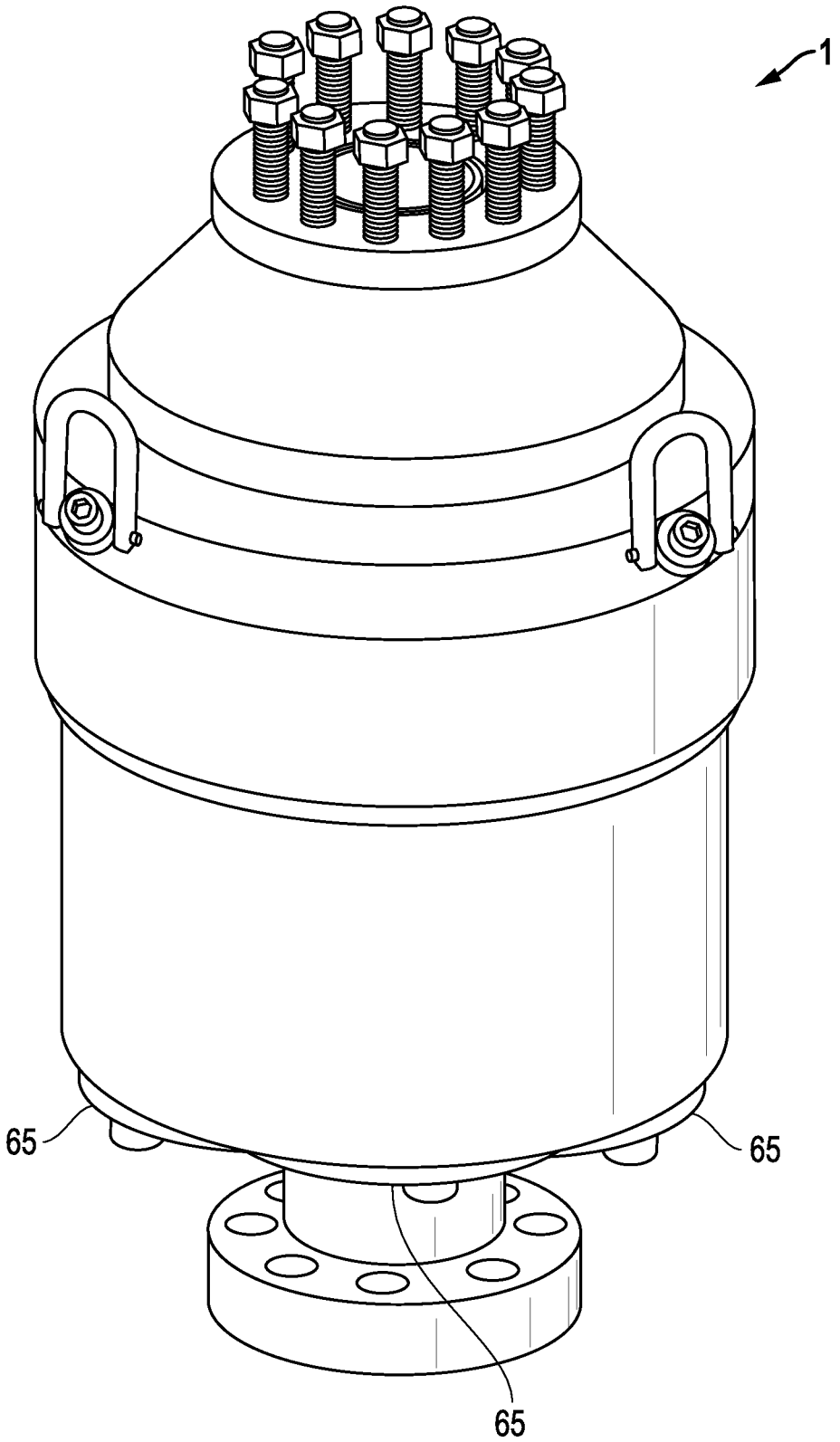
FIG. 1 illustrates a perspective view of a blowout preventer assembly according to one of one embodiment.

Before explaining at least one embodiment of the invention in detail, it is to be understood that the invention is not limited in its application to the details of construction and to the arrangements of the components set forth in the following description or illustrated in the drawings. The Figures and written description are provided to teach any person skilled in the art to make and use the inventions for which patent protection is sought. The invention is capable of other embodiments and of being practiced and carried out in various ways. Those skilled in the art will appreciate that not all features of a commercial embodiment are shown for the sake of clarity and understanding. Persons of skill in the art will also appreciate that the development of an actual commercial embodiments incorporating aspects of the present inventions will require numerous implementation specific decisions to achieve the inventors' ultimate goal for the commercial embodiment. While these efforts can be complex and time-consuming, these efforts nevertheless would be a routine undertaking for those of skill in the art having the benefit of this disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," and "surface" are used in the description for clarity in specific reference to the Figures and are not intended to limit the scope of the invention or the appended claims. Further, it should be understood that any one of the features of the invention can be used separately or in combination with other features. Other systems, methods, features, and advantages of the invention will be or become apparent to one with skill in the art upon examination of the Figures and the detailed description. It is intended that all such additional systems, methods, features, and advantages be included within this description, be within the scope of the present invention, and be protected by the accompanying claims.

Reference will now be made in detail to an implementation consistent with the present invention as illustrated in the accompanying drawings. For the purpose of clarification, embodiments described herein reference the term "fluid," which refers to a gas, liquid, as well as liquid solution with solid aggregates, as well as any other material that can reasonably be expected to flow.

Referring to FIG. 1, by way of non-limiting example, and consistent with embodiments of the invention, a blowout preventer assembly 1 is shown, wherein the blowout preventer assembly 1 is hydraulically actuated and is annular-spherical in overall design. When describing the operational function of the present embodiment of the blowout preventer assembly 1, the volume of hydraulic fluid to effectuate desired operation is about 4 gallons to "close" and about 3½ gallons to "open" a main seal 25 (see FIGS. 2 and 3A) of the blowout preventer assembly 1. Further, in the preferred embodiment, the inner dimensions of well pipe that can be accommodated can range from about 5½ inches to about 21¼ inches. All metal components utilized in manufacture of the present embodiment, when possible and not restricted by pressure constraints or other operational reasons, are manufactured and machined from commercially available 4130 steel. One skilled in the art will recognize that other diameters, types and thicknesses of steel or preferred materials can be utilized when taking into consideration safety and the high pressure functioning capacity of the present embodiment which can range in operation from 3,000 psi to 20,000 psi.

Figure 2:
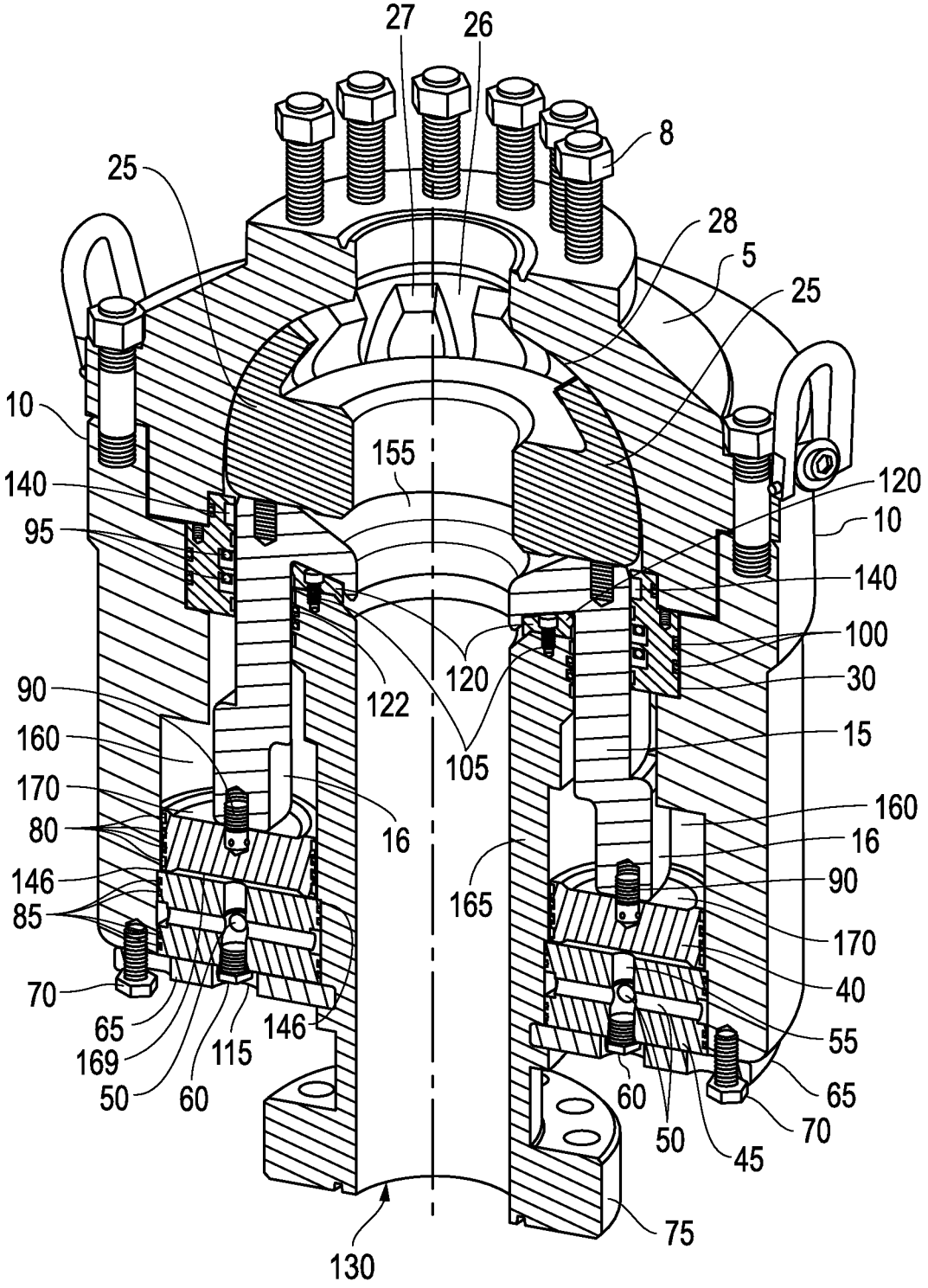
FIG. 2 illustrates a cross-sectional perspective view of the blowout preventer assembly connected according to one embodiment.
Figure 3A:
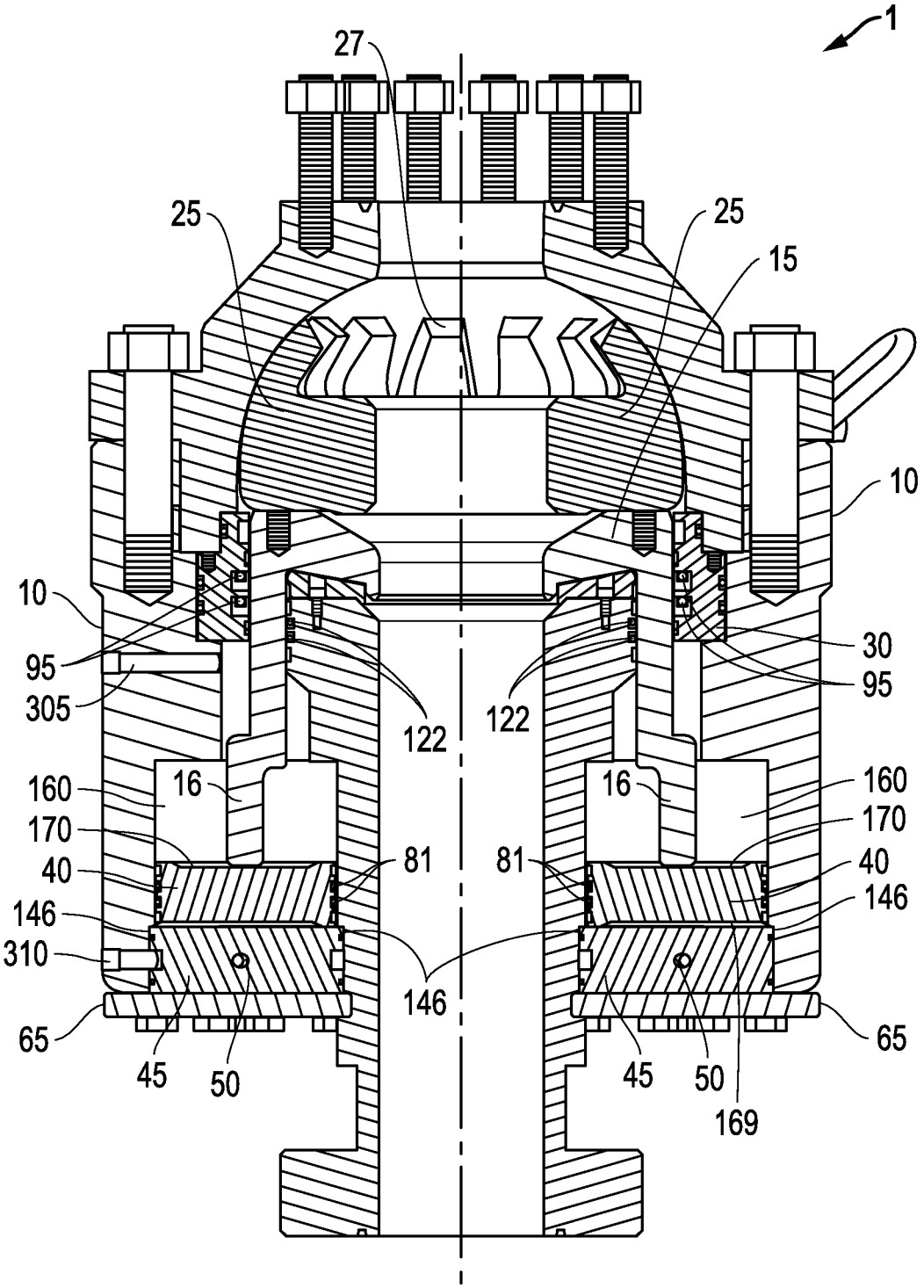
FIG. 3A illustrates a cross-sectional elevation view of the blowout preventer assembly rotated approximately 90 degrees from that as shown in FIG. 2, according to one embodiment.

The blowout preventer assembly 1 will now be discussed in detail with reference to FIG. 1 and the cross-sectional views as shown in FIGS. 2 and 3A together, wherein FIG. 3A is rotated clockwise in view about 90 degrees as compared to the view depicted in FIG. 2. The blowout preventer assembly 1 comprises a plurality of constituent components that provide blowout prevention in oil and gas well operation through implementation and operation of a plurality of annular pistons 40 (also shown in specific detail in FIG. 3C), as will be further described. The blowout preventer assembly's 1 containment structure is generally configured having a lower housing 10 with a plurality of internal fluidly interconnected cylinders 160, an upper housing 5 (also shown in specific detail in FIG. 6), a one piece energizing ring 15 (also shown in specific detail in FIG. 4), and a plurality of individual bottom cover plates 65 (as shown in FIGS. 1, 2, 3A and 3C). The blowout preventer assembly 1 also comprises a commercially available off-the-shelf main seal 25 with a plurality of main seal ribs 27, an adaptor ring 30, a plurality of glands 45 (also shown in specific detail in FIG. 3C) dedicated to each annular piston 40, and various dedicated and associated seals and threaded attachments which will be detailed hereinbelow with associated components. The main seal is positioned over a bowl 155 machined into one end of the energizing ring 15.

Figure 6:
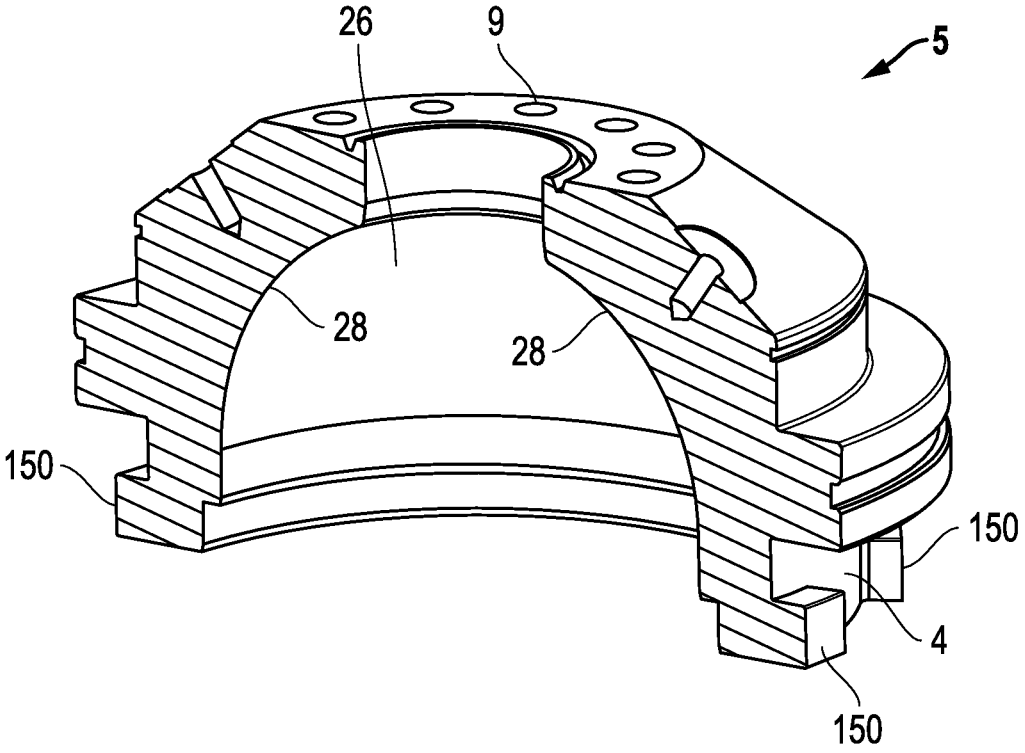
FIG. 6 illustrates a cross-sectional view of an upper housing utilized with one embodiment of the blowout preventer.

Referring to FIGS. 2, 3A and 6 together, the present embodiment of the blowout preventer assembly 1 comprises the upper housing 5 having a concave inner design defining a spherical or concave shaped main bore 26 in an inner ceiling 28 of the upper housing 5 that allows for accommodation, fitment and operation of the main seal 25. The main bore's 26 inner ceiling's 28 concave design provides circumferential closure guidance and integrity to bifurcations the main seal 25 which for the main seal ribs 27. The main seal ribs 27 function in conjunction with the inner ceiling 28 shape to cause sealing closure around and contact with the outer diameter of pipe (not shown) positioned within the lower housing column bore 130 when demand for closure of the blowout preventer assembly 1 is required by induced well bore factors. The upper housing 5 further comprises a series of spaced about female threaded connections 9 for receiving upper housing bolts 8 used to provide attachment and securement of other desired gas or oil well/drilling components. Further provided in an upper housing attachment end 4 of the upper housing 5 are a plurality of spaced apart individually machined bifurcated upper housing retainer lugs 150 for secured attachment with the lower housing 10 as will be described below. The bifurcated upper housing retainer lugs 150 are positionally machined in a bifurcated spaced apart protruding fashion about an outer circumference of an upper housing attachment end 4, as shown in FIG. 6. The bifurcated upper housing retainer lugs 150 operate to interlace, lock and secure, once mated, the lower housing 10 with the upper housing 5 via a quarter turn twist, thus securing both together.

Figure 5:
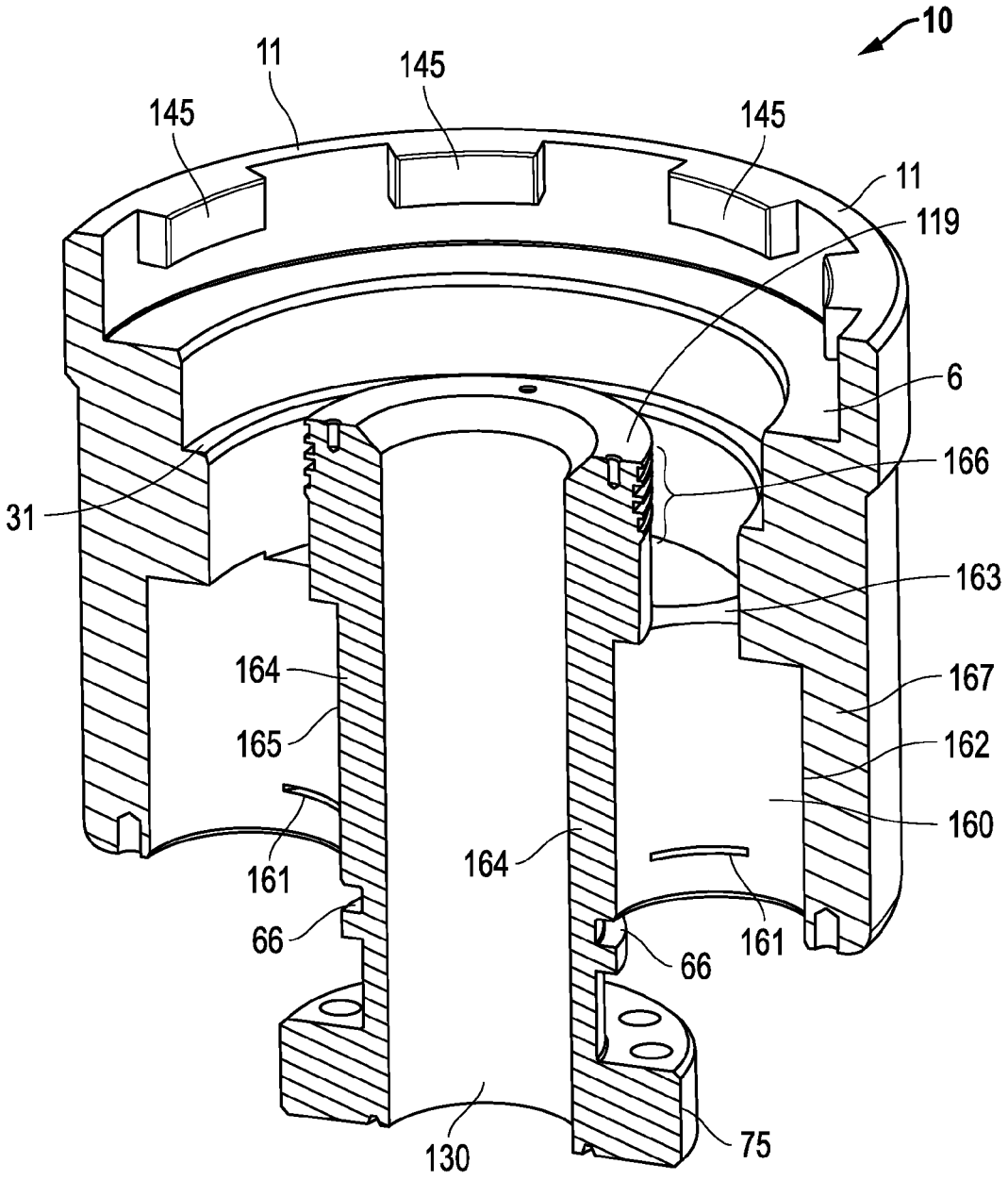
FIG. 5 illustrates a cross-sectional view of a lower housing utilized with one embodiment of the blowout preventer.

Referring to FIGS. 2, 3A, and 5 together, the present embodiment of the blowout preventer assembly 1 comprises the lower housing 10 having a unitary structure design that provides for and contains much of the functional components and machined portions of the overall blowout preventer assembly 1. Specifically, the unitary structure of the lower housing 10 defines a generally cylindrical shape having a lower housing flange 75, a plurality of machined bifurcated lower housing retainer lugs 145, a lower housing wall 167, a machined upper seat 6, a machined upper shoulder 119, a lower seat 31, a lower housing column 164 having a lower housing column wall 165 which defines an inner area of the lower housing column bore 130, lower housing column wall seals 166, and a plurality of internal fluidly interconnected cylinders 160 machined into a cylinder plane surface 163 wherein each cylinder has a dedicated cylinder fluid channel 161. Each of the previous mentioned components and its integral function will be further detailed hereinbelow.

An upper shoulder seal 120 and an adapter ring upper seal 140 are utilized as mud and cutting scrapers and are designed to prevent ingress of mud and cuttings into a plurality of column primary seals 122 and into a plurality of primary seals 95 and as a result prolongs the overall life of each. The upper shoulder seal 120 is removably attached to and circumferentially rests around and on the surface of an upper shoulder 119 via a plurality of upper shoulder seal retaining bolts 105 and is further secured into position via a retainer lip 118 on the energizing ring 15. An adapter ring 30, having a plurality of adapter ring primary seals 95 and a plurality of adapter ring secondary seals 100, is removably disposed on a lower seat 31 around the outer diameter of the adapter ring 30 and covering the area adjacent to the adapter ring upper seal 140 and the adapter ring primary seal 95 to prevent external escape of pressure built up in the blowout preventer assembly 1.

The lower housing 10 mates for operation with the upper housing 5 and the bifurcated upper housing retainer lugs 150 in a rotatable locking attachment fashion via a plurality of spaced apart and machined bifurcated lower housing retainer lugs 145 similar to those machined into the upper housing 5 described above. The plurality of bifurcated lower housing retainer lugs 145, however, are positionally machined in a bifurcated spaced apart protruding fashion about an inner circumference of a lower housing attachment end 11, as shown in FIG. 5. The bifurcated lower housing retainer lugs 145 function to interlace, lock and secure, the lower housing 10 with the upper housing 5 via a quarter turn twist once mated together and the upper housing 5 is properly seated on the upper seat 6 of the lower housing 10. The bifurcated upper housing retainer lug 150 and bifurcated lower housing retainer lug 145 connection design also allows rapid disassembly and assembly in-house and in the field.

The present embodiment of the lower housing 10, as shown in FIGS. 2, 3A and 5 permits flow supply of demanded hydraulic fluid into the plurality of internal fluidly interconnected cylinders 160 through two primary supply ports, either an open port 305 or close port 310. The close port 310 supplies hydraulic pressure in the bottom or close side of each annular piston 40 to activate the main seal 25. When the main seal 25 is activated from hydraulic fluid pressure through the close port 310 the blowout preventer assembly 1 is closed and the well bore is isolated and thus prevents well bore pressure from migrating above the main seal 25. When the main seal 25 is activated from the open port 305, hydraulic fluid pressure is supplied into an open side of the annular piston 40. The open and close function will be further described below.

As shown with specific reference to FIG. 5, in a preferred embodiment, six (6) internal fluidly interconnected cylinders 160 are machined into the steel body of the lower housing 10. Each internal fluidly interconnected cylinder 160 is machined bored into a cylinder plane surface 163 that is located in a radial area bounded by the lower housing wall 167 and the lower housing column wall 165. Each of the internal fluidly interconnected cylinders 160 is substantially equally spaced apart from adjacent cylinders. The fluid interconnectivity of each internal fluidly interconnected cylinders 160 within the lower housing 10 is achieved via implementation of the machined cylinder fluid channel 161 disposed in a horizontal plane within a circumferential portion of a cylinder wall 162 within each of the internal fluidly interconnected cylinders 160.

Figure 3B:
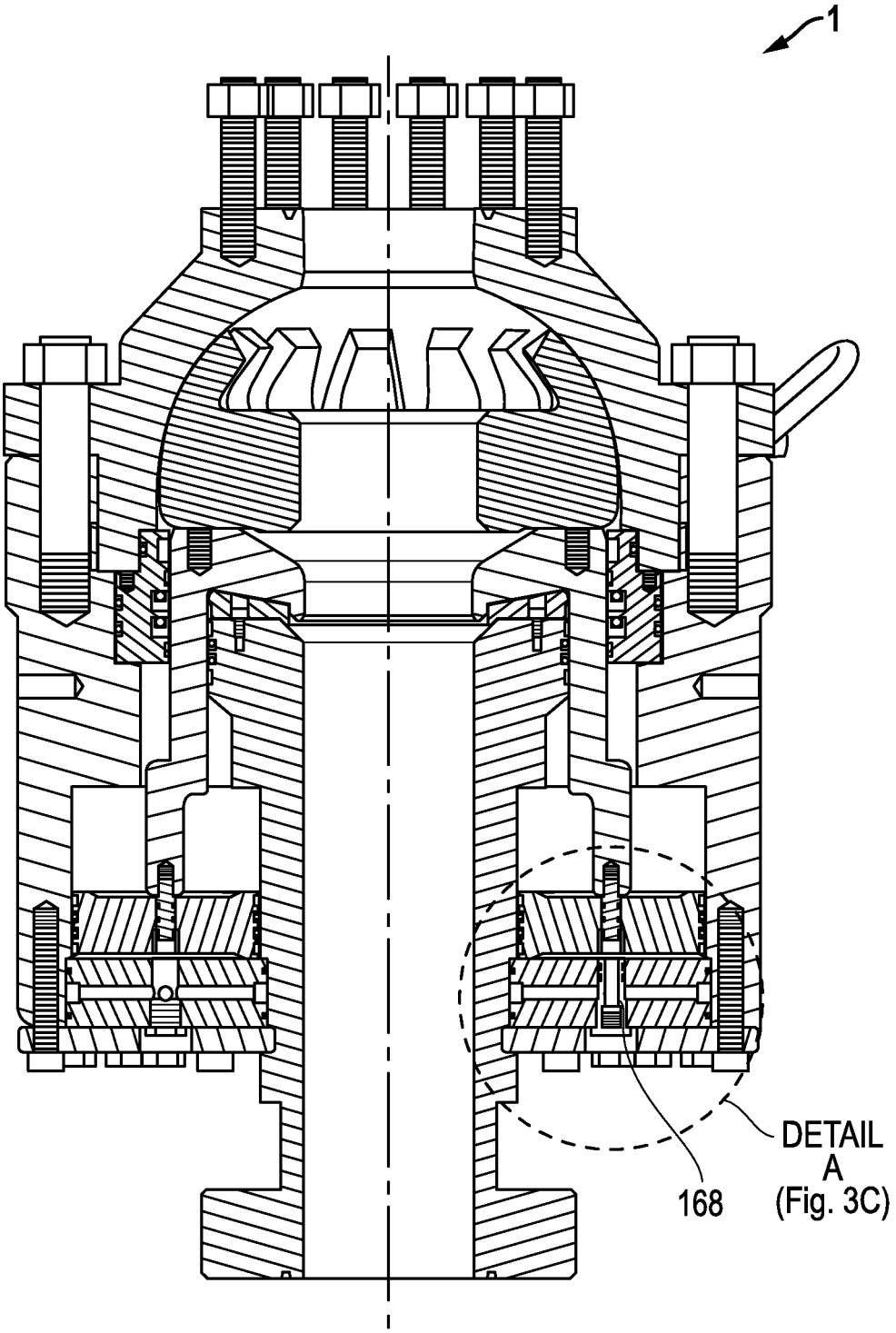
FIG. 3B illustrates a cross-sectional elevation view of the blowout preventer assembly with Detail A of an annular piston and associated gland indicated according to one embodiment.
Figure 3C:
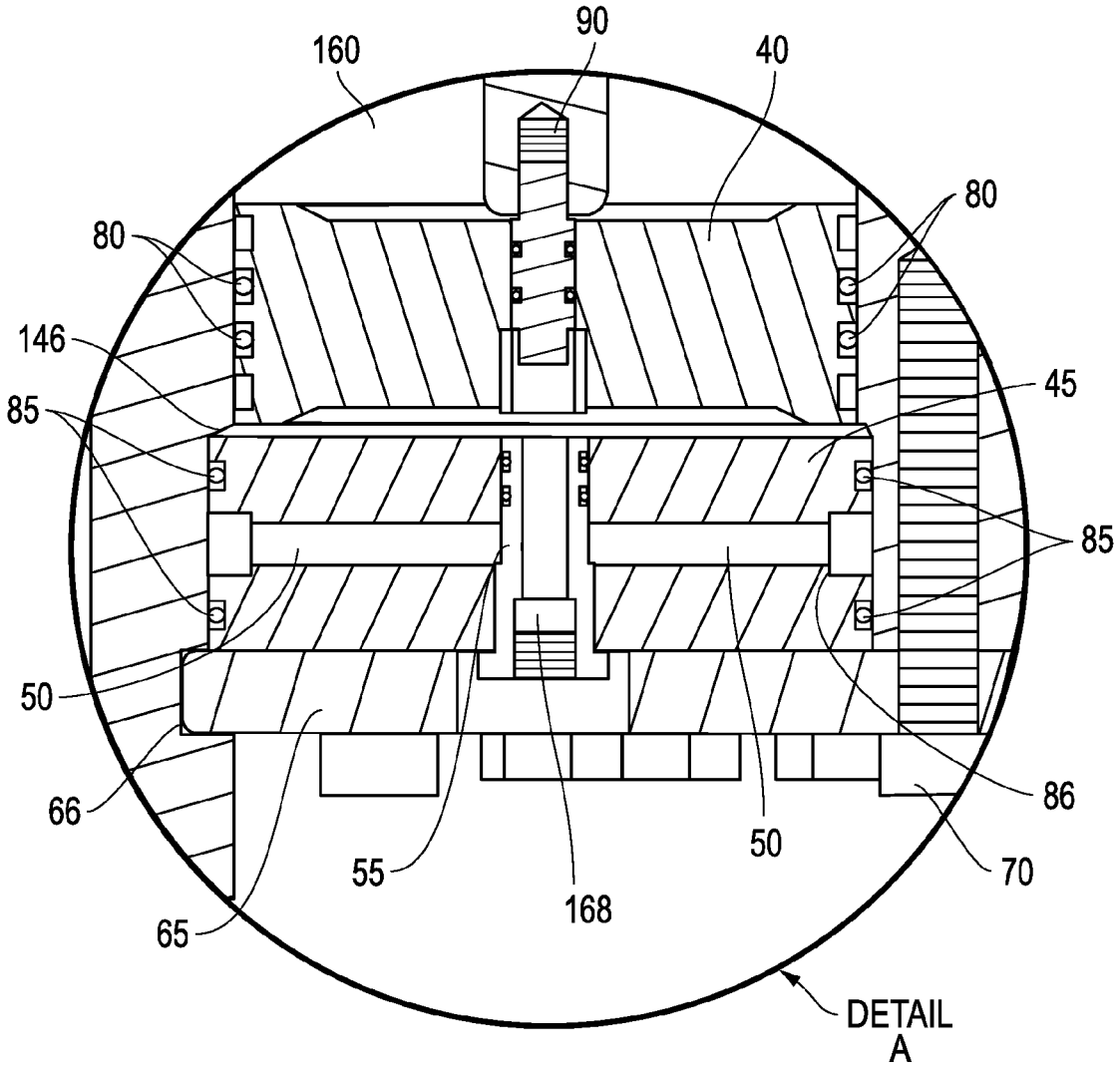
FIG. 3C illustrates a close-up depiction of Detail A as shown in FIG. 3B of a cross-sectional side view of the annular piston and gland according to one embodiment.

A gland 45 having a circumferential channel 86, as shown in FIGS. 2, 3A, and 3C, with a plurality of gland seals 85 is disposed in a distal portion of the internal fluidly interconnected cylinder 160, wherein the distal portion of the internal fluidly interconnected cylinders 160 diameter that surrounds the gland 45 is of a second diameter larger than the first inner diameter of the internal fluidly interconnected cylinder 160 that encloses the annular piston 40. Such smaller inner diameter portion of the cylinder 160 that encloses the annular piston 40 serves as a stop lip 146 and prevents movement during operation, or otherwise, of the gland 45 into the internal fluidly interconnected cylinder 160 portion enclosing the annular piston 40. During all operations the gland 45 is removably fixed in a stationary position and attached to a bottom cover plate 65 with a half tap gland plug 60. The only time the gland 45 is removed is for repair or replacement of the annular piston 40 or the gland 45. The gland 45 can also be used as a secondary access to provide hydraulic power into the annular piston 40. The gland 45 is the primary component that provides for test access and isolation of the annular pistons 40.

As shown in FIGS. 3B and 3C an isolation and test plug 168 is provided for conducting pressure testing on an individual internal fluidly interconnected cylinder 160 or an annular piston 40. The isolation and test plug 168 can be used when inserted into the gland test plug cavity 55 via an access aperture 115 to isolate an inoperable annular piston 40 from all other annular pistons 40 within the blowout preventer assembly 1, thereby preventing substantial downtime to drilling operations. During normal operations, the isolation and test plug 168 is removed and is not present and is replaced by the half tap gland plug 60 for continued operations. FIGS. 2 and 3C show the cross section of the gland 45. The gland 45 has two longitudinal gland channels 50 traversing an inner portion of the gland 45. The gland channel 50 allows hydraulic fluid to flow to the annular piston 40 in the same internal fluidly interconnected cylinder 160 and allows hydraulic fluid to flow to the cylinder wall 162 and into the cylinder fluid channel 161, thereby providing the aforementioned internal fluidly interconnected cylinder's 160 interconnectivity. The bottom cover plates 65 are positioned in a plate channel 66 and are removably attached by a plurality of threaded fasteners, such as bottom cover plate bolts 70 into the lower housing 10 to secure the glands 45 in place and to provide for easy access to the annular pistons 40 and the gland 45 for maintenance and/or removal.

The diameter and bore length of the internal fluidly interconnected cylinders 160 are a predetermined factor and are based on of the overall size and dimensions of the blowout preventer assembly 1 design which is dictated by operational necessity. Each annular piston 40 is fabricated having an annular design of predetermined diameter to provide proper fitment within the inner diameter of the internal fluidly interconnected cylinder 160. The diameter and thickness of each annular piston 40 is dependent upon pressure requirements and other specifications of the overall blowout preventer assembly 1 size and design. One skilled in the art will recognize the overall blowout preventer assembly 1 size requirements and the internal fluidly interconnected cylinder 160, annular pistons 40 and other herein described components and associated sizing required can vary in size, length, diameter and type of steel for proper operation without departing from the scope and spirit of the invention. The preferred embodiment can operate in the field to provide blowout prevention capability with fewer than six (6) functioning annular pistons 40 disposed in the internal fluidly interconnected cylinders 160. However, blowout prevention is severely diminished or threatened with three (3) or fewer operating internal fluidly interconnected cylinders 160 and/or annular pistons 40.

Figure 4:
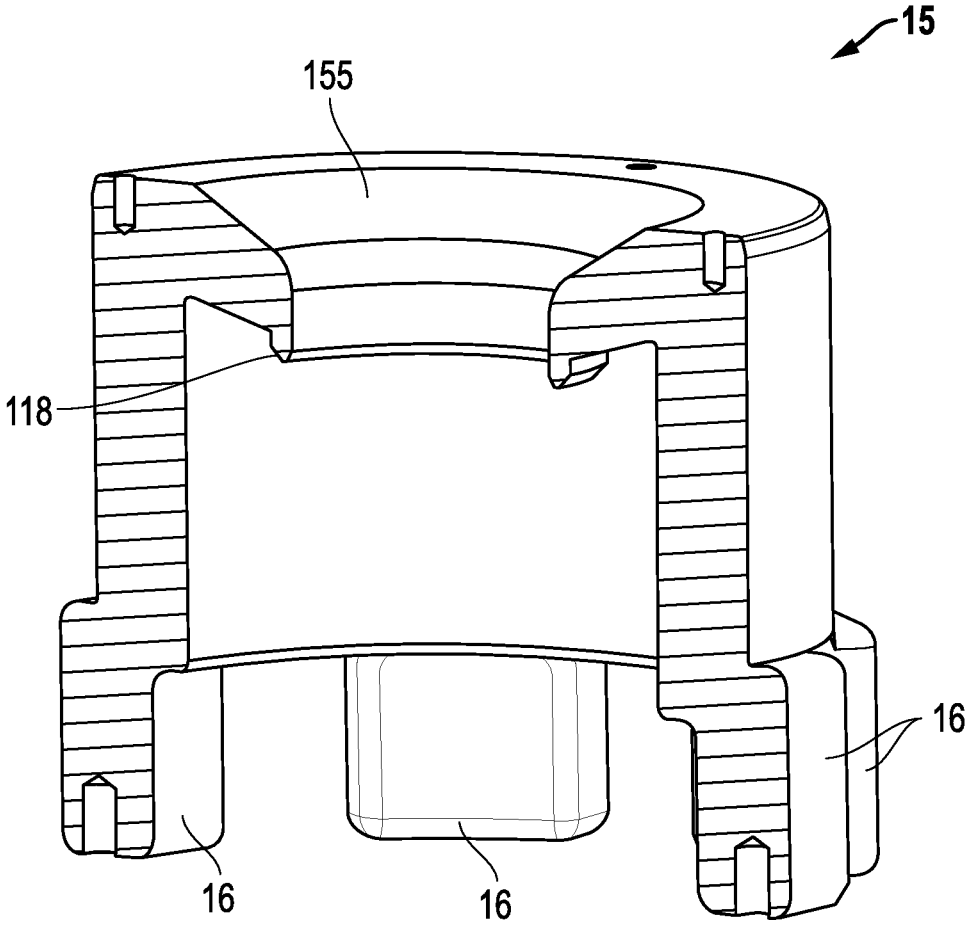
FIG. 4 illustrates a cross-sectional view of an energizing ring utilized with one embodiment of the blowout preventer.

As shown in FIGS. 2, 3C and 4, the annular piston 40 is removably attached to a surface of a heel 16 on the energizing ring 15 by way of a piston connector 90 for enabling operation of the blowout preventer assembly 1 to facilitate proper and sufficient component movement for ultimate closure of the main seal ribs 27 of the main seal 25 around a pipe (not shown) when positioned within the lower housing column bore 130 and closure is demanded through a close port 310 due to hydraulic fluid operation. The annular pistons 40 have a plurality of side perimeter grooves 81 for accommodating associated piston seals 80 to prevent pressurized fluid leakage into undesired portions of the internal fluidly interconnected cylinder 160.

As shown in FIGS. 2 and 3A, the lower housing 10 and upper housing 5 also enclose the energizing ring 15. The energizing ring 15 (detailed in FIG. 4) is disposed such that at least three of the heels 16, being bifurcated in a equidistant and spaced apart fashion about a distal end of the energizing ring 15 can functionally engage at least three (3), preferably six (6), independent annular pistons 40, wherein the internal fluidly interconnected cylinders 160 and annular pistons 40 form a honeycomb design within the lower housing 10. The energizing ring 15 heels 16 are each separately connected to one side of the heels' 16 accompanying annular pistons 40 via a piston connector 90 comprised of a male threaded bolt, seals and a nut. The piston connector 90 allows removal of either the annular piston 40 or the energizing ring 15.

Now, the close and open operation of the blowout preventer assembly 1 will be described with reference to the Figures in general but with specific reference to FIG. 3A. To close the blowout preventer assembly 1, hydraulic fluid pressure is primarily supplied through the close port 310. The hydraulic pressure provided exerts force on a piston close side 169 to move the annular pistons 40 against the heel 16 of the energizing ring 15. The force generated by the hydraulic pressure will then be transferred to the main seal 25 via the energizing ring 15. This will cause closure to the main bore 26 of the blowout preventer assembly 1 thereby preventing all well bore pressure from escaping.

To open the blowout preventer assembly 1, hydraulic pressure is primarily supplied through the open port 305. The hydraulic pressure provided exerts force on a piston open side 170 to move the annular pistons 40 in a direction toward the gland 45. The force generated by the hydraulic pressure will then be transferred to the energizing ring 15 and will cause opening of the main seal 25 and as a result will open the main bore 26 of the blowout preventer assembly 1.

One of skill in the art will recognize that the embodiments described above are not limited to any particular size and the size of the blow out preventer and will depend upon the particular application and intended components. It will be appreciated by those skilled in the art that changes could be made to the embodiments described above without departing from the broad inventive concept thereof. It is understood, therefore, that the invention disclosed herein is not limited to the particular embodiments disclosed, and is intended to cover modifications within the spirit and scope of the present invention.

What is claimed is:

1. A blowout preventer assembly comprising:

a containment structure, wherein the containment structure comprises:

a unitary lower housing with a plurality of lower housing bifurcated retainer lugs disposed circumferentially about an attachment end of the lower housing, wherein the lower housing further includes a plurality of internal fluidly interconnected cylinders;

a plurality of annular pistons and a plurality of glands engaging the plurality of fluidly interconnected cylinders in the lower housing;

a one piece energizing ring having a bowl in one end portion, wherein the energizing ring is operationally disposed circumferentially about a portion of the lower housing and in engagement with the plurality of annular pistons;

an upper housing having an integral structure with a plurality of upper housing bifurcated retainer lugs for interlace quarter turn engagement with the lower housing plurality of bifurcated retainer lugs, wherein the upper housing further includes an inner ceiling with a spherical, concave shaped main bore for accommodating a main seal positioned over the bowl portion, wherein the lower housing and upper housing operationally enclose the one piece energizing ring, the plurality of annular pistons, the plurality of glands and the main seal; and a plurality of individual bottom plates for sealing the lower housing from an outside environment;

wherein each of the plurality of internal fluidly interconnected cylinders has a first inner diameter for properly accommodating an outer diameter of each of the plurality of annular pistons and a second larger inner diameter for accommodating an outer diameter of each of the plurality of glands, such that the juncture of the first inner diameter and the second inner diameter form a stop lip, wherein each of the plurality of glands is positionally retained within a distal portion of each internal fluidly interconnected cylinder by the stop lip; and wherein each of the plurality of glands further comprise a gland test plug cavity for accommodating an isolation and test plug, wherein the isolation and test plug provides on-site operational pressure testing on any of the plurality of individual internal fluidly interconnected cylinders or any of the plurality of annular pistons.

2. The blowout preventer assembly of claim 1, wherein the plurality of internal fluidly interconnected cylinders each further comprise a dedicated cylinder fluid channel disposed therein a portion of a cylinder wall of each internal fluidly interconnected cylinder, wherein the cylinder fluid channel permits hydraulic fluid interconnectivity of each internal fluidly interconnected cylinder.

3. The blowout preventer assembly of claim 1, wherein the lower housing comprises an open port and close port for accommodating hydraulic connections for providing and relieving hydraulic fluid to cause the annular pistons to force the energizing ring in a direction to open or close the main seal.

4. The blowout preventer assembly of claim 3, wherein hydraulic fluid flows through the close port to the plurality of glands, wherein each of the glands further comprises a plurality of longitudinal gland channels traversing the diameter of each of the plurality of glands and a circumferential channel about the circumference of each of the plurality of the glands, wherein each of the plurality of longitudinal gland channels and the circumferential channels combine in design and function to accommodate the hydraulic fluid flow to responsively effectuate movement of the piston and energizing ring in a direction to cause the seal to close.

5. The blowout preventer assembly of claim 1, wherein the inner diameter dimensions of well pipe that can be accommodated range from about 5½ inches to about 21¼ inches.

6. The blowout preventer assembly of claim 1, wherein a high pressure functioning capacity can range from 3,000 psi to 20,000 psi.

* * * * *